US008234851B2

(12) United States Patent
Wright

(10) Patent No.: US 8,234,851 B2
(45) **Date of Patent: *Aug. 7, 2012**

(54) TOOL AND METHOD FOR CREATING FASHION ACCESSORIES

(75) Inventor: Sheila Wright, Bloomfield Hills, MI (US)

(73) Assignee: Ann Williams Group, LLC, Bloomfield Hills, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/425,004

(22) Filed: Mar. 20, 2012

(65) Prior Publication Data

US 2012/0174405 A1 Jul. 12, 2012

Related U.S. Application Data

(63) Continuation of application No. 13/357,053, filed on Jan. 24, 2012.

(60) Provisional application No. 61/435,561, filed on Jan. 24, 2011, provisional application No. 61/495,439, filed on Jun. 10, 2011.

(30) Foreign Application Priority Data

Jan. 23, 2012 (WO) ..... PCT/US2012/022203

(51) Int. Cl.
*D02G 3/38* (2006.01)

(52) U.S. Cl. ..... 57/10

(58) Field of Classification Search ..... 57/3, 10, 57/11, 12

See application file for complete search history.

(56) References Cited

U.S. PATENT DOCUMENTS

| | | | | |
|---|---|---|---|---|
| 154,342 | A * | 8/1874 | Reinwarth | 57/11 |
| 827,552 | A | 7/1906 | McCloud | |
| 1,336,649 | A | 4/1920 | Musson | |
| 2,279,563 | A * | 4/1942 | Dye | 73/866 |
| 2,353,727 | A * | 7/1944 | Howard | 242/441.2 |
| 2,460,478 | A * | 2/1949 | Warner | 242/441.2 |
| 2,607,185 | A | 8/1952 | Silverman | |
| 2,765,003 | A | 10/1956 | Willis et al. | |
| 2,971,319 | A | 2/1961 | Spencer | |
| 3,504,488 | A | 4/1970 | Illman | |
| 3,526,085 | A | 9/1970 | Illman | |

(Continued)

FOREIGN PATENT DOCUMENTS

EP 2172144 A1 4/2010

(Continued)

OTHER PUBLICATIONS http://www.schoolhousepress.com/kits.htm (Jan. 24, 2010, via http://archive.org).*

(Continued)

*Primary Examiner* — Shaun R Hurley
(74) *Attorney, Agent, or Firm* — Dobrusin & Thennisch PC

(57) ABSTRACT

A device comprising: (a) a body portion including: (i) a first end and ii. a second end; (b) a holder at the first end; (c) a holder at the second end; (d) a rotation device at the first end in communication with the holder at the first end; and wherein the holder is fixedly attached to a split gear having a channel therethrough so that one or more flexible mediums may be placed through the channel and removed from a work area located between the holder at the first end and the holder at the second end.

20 Claims, 4 Drawing Sheets

U.S. PATENT DOCUMENTS

| | | | | |
|---|---|---|---|---|
| 4,292,797 | A * | 10/1981 | Auger | 57/24 |
| 4,562,870 | A * | 1/1986 | Calvin | 140/149 |
| 4,704,855 | A | 11/1987 | Yoshida et al. | |
| 4,765,129 | A | 8/1988 | Jodoin et al. | |
| 5,927,059 | A | 7/1999 | Goertz | |
| 6,321,519 | B1 | 11/2001 | Goertz | |
| 6,401,442 | B1 * | 6/2002 | Root et al. | 57/27 |
| 7,780,109 | B1 | 8/2010 | Park | |
| 2009/0241341 | A1 | 10/2009 | Solanilla | |
| 2010/0212770 | A1 | 8/2010 | Weidler et al. | |
| 2011/0204554 | A1 | 8/2011 | Younger | |

FOREIGN PATENT DOCUMENTS

| | | | |
|---|---|---|---|
| JP | 2010/261130 | A | 11/2010 |
| JP | 2011/117103 | A | 6/2011 |

OTHER PUBLICATIONS

Alex Toys Friendship Wheel, Available at www.alextoys.com/product/137W, last accessed Jan. 17, 2011.

Mary Maxim, My Friendship Bracelet Maker, Available at www.marymaxim.com, last accessed Jan. 17, 2011.

Alex, Friend 2 Friend Friend Bracelet Kit, Available at www.amazon.com/Ales-Friend-friendship-Bracelet-Kit.dp/B009S5U08, last accessed Jan. 17, 2011.

Spin Master, Girl Crush Hair Extension Studio, Available at http://www.amazon.com/Girl-Crush-Hair-Extension-Studio/dp/B0016A8XK2/ref=2sr__1__8?s=toys-and-games&ie=UTF8&qid=1332251344&sr=1-8; last accessed Mar. 20, 2012.

Alex Toys, Friends 4 Ever Bracelet Making Kit, Available at http://www.amazon.com/Alex-Toys-Friends-Bracelet-Making/dp/B001OXRTX8, last accessed Dec. 13, 2010.

Co-pending U.S. Appl. No. 13/357,053, filed Jan. 24, 2012.

Office Action for U.S. Appl. No. 13/357,053, mailed on May 22, 2012.

Co-pending U.S. Appl. No. 29/412,870, filed Feb. 8, 2012.

Co-pending U.S. Appl. No. 61/597,314, dated Feb. 10, 2012.

International Search Report Application No. PCT/US2012/022203, filed on Jan. 23, 2012.

* cited by examiner

TOOL AND METHOD FOR CREATING FASHION ACCESSORIES

CLAIM OF PRIORITY

The present application is a continuation application of application Ser. No. 13/357,053, filed Jan. 24, 2012, which claims the benefit of the filing date of PCT Application No PCT/US12/22203 filed on Jan. 23, 2012, U.S. Provisional Application No. 61/435,561, filed Jan. 24, 2011, and U.S. Provisional Application No. 61/495,439, filed Jun. 10, 2011, all of which are hereby expressly incorporated by reference

FIELD OF THE INVENTION

The present teachings generally relates to a device for creating articles and/or fashion accessories, and a method of using the device to create articles and/or fashion accessories such as friendship type bracelets, necklaces, rings, belts, headbands, or the like.

BACKGROUND

Typical, friendship bracelets, necklaces, rings, or the like intertwine multiple different colored pieces of string, floss, yarn, cord, or some other flexible colored material. This may be accomplished without the use of any device; however, devices may be employed to keep the strings separated. These devices may also allow a user to employ more strands by organizing the strands for the user. These devices slightly simplify the process but are still time consuming, confusing to the user, and frustrating to younger children. Examples of such devices are disclosed in U.S. Patent Application Publication No. 2010/0212770 and Alex Toys Friendship Wheel, Available at www.alextoys.com/product/137W. last accessed Jan. 17, 2011; Mary Maxim, My Friendship Bracelet Maker, Available at www.marymaxim.com, last accessed Jan. 17, 2011; and Alex, Friend 2 Friend Friend Bracelet Kit, Available at www.amazon.com/Alex-Friend-Friendship-Bracelet-Kit/dp/B0009S5U08, last accessed Jan. 17, 2011 all of which are expressly incorporated herein by reference for all purposes.

Some disadvantages faced by known devices are that these devices minimally assist in: the creation of the accessory; reducing the complexity; improving the organization of threads for the various weaving patterns, or a combination thereof. They further suffer a disadvantage in that they don't dramatically increase the simplicity or significantly reduce time required to create the jewelry. These guides and/or aids do not significantly reduce the time to create an accessory by mechanically assisting in the creation of an accessory. It would be attractive to have a device/tool that could assist in the creation of these or similar jewelry by reducing the complexity and time required to make the jewelry.

Other known devices may employ a rod so that a rigid metallic, medium may be wrapped around the rod in order to create jewelry. These devices suffer from the disadvantage that it is difficult to use multiple mediums simultaneously and the combination of color, material, size, or a combination thereof may not vary along the length of the jewelry. Furthermore, the diameter of the fashion accessory may not be easily varied from piece to piece without modifications to the device. These devices use a rigid medium which may be difficult for young children to manipulate, cut, handle, sculpt, or a combination thereof and may not be safe for very young children to use and/or wear. Additionally, such devices may employ drive chains. The drive chains may be subject to disengagement due to a lateral force such as force on the crank during normal operation, dropping, bumping, or a combination thereof. The disengaged drive chains may be difficult to re-engage especially for a younger user. Further, the drive chains may stretch over time and cause slippage, disengagement, or both. Examples of such devices are disclosed in U.S. Pat. Nos. 5,927,059 and 6,321,519 both of which are expressly incorporated herein by reference for all purposes. Thus, there is a need for a device that simplifies creation of fashion accessories so that young children may quickly and easily make fashion accessory. There is also a need for a simple device that increases the user's sense of input and creative direction, while optimizing the flexibility for generating different types of jewelry, fashion accessories, designs, configurations, color combinations, or a combination thereof. There is a need for a durable device that has a high level of lateral stability so that the device can withstand dropping, bumping, and continual use without moving parts becoming disengaged and requiring repair and/or realignment.

SUMMARY

One possible embodiment of the present teachings is a device comprising: a body portion including: a first end and a second end; a holder at the first end; a holder at the second end; a rotation device at the first end in communication with the holder at the first end; and wherein the holder is fixedly attached to a split gear having a channel therethrough so that one or more flexible mediums may be placed through the channel and removed from a work area located between the holder at the first end and the holder at the second end.

One possible embodiment of the present teachings is a device includes a device comprising: a device comprising: a body portion including: a first end region and a second end region spaced apart from the first end region, each end region includes an outwardly projecting support; a holder carried on each of the supports defining a spacing therebetween; a plurality of inter-meshing gears on at least one side; at least one structure for preventing lateral translation; and a rotation device in rotatable driving relation with at least one of the holders and the plurality of inter-meshing gears, wherein the spacing of the holders is sufficient so that when an elongated strand of a flexible filament is removably attached to each of the holders; a core with a longitudinal axis is defined, the core being in a state of tension, and the rotation device is such that at least one holder is rotated generally about the longitudinal axis of the core while a predetermined length of a filament that is either completely unattached to a holder, a core, or both is fed generally tangentially to the core thereby forming a series of consecutive adjoining loops around the core.

One unique aspect of the present teachings envisions: a method comprising: (a) obtaining the device of the teachings herein; (b) attaching one or more flexible mediums to the holder at the first end; (c) attaching at least one flexible medium to the holder at the second end so that a core is formed between the first end and the second end; (d) continuing to perform steps (b) and (c) until a core of the desired size is achieved; (e) turning either the rotation knob at the first end or the rotation knob at the second end; (f) wrapping at least one flexible medium around the core; and (g)repeating steps (e) and (f) until a desired length of a fashion accessory is created.

Another unique aspect of the present teachings envisions a kit including the device described herein, flexible mediums, secondary mediums, or a combination thereof, which may be use the method described herein to create an article and/or fashion accessory.

One unique aspect of the present teachings is a device that assists in holding multiple strands of different flexible mediums so that the flexible mediums can be quickly and efficiently arranged to create an article and/or fashion accessories. The device includes numerous different configurations so that the complexity of the process is simplified so that fashion accessories may be created by the user without minimizing user input, creativity, originality, or a combination thereof.

Another unique aspect of the present teachings is a process of using the device described herein to create unique and original articles and/or fashion accessories. The method of creating unique and original articles and/or fashion accessories may change from user to user so that each user may create their own unique and original designs. The method for creating articles and/or fashion accessories described herein provides a simple and elegant solution so that users of all ages may use the device described herein to create their own unique and original articles and/or fashion accessories.

DETAILED DESCRIPTION

Figure 1:
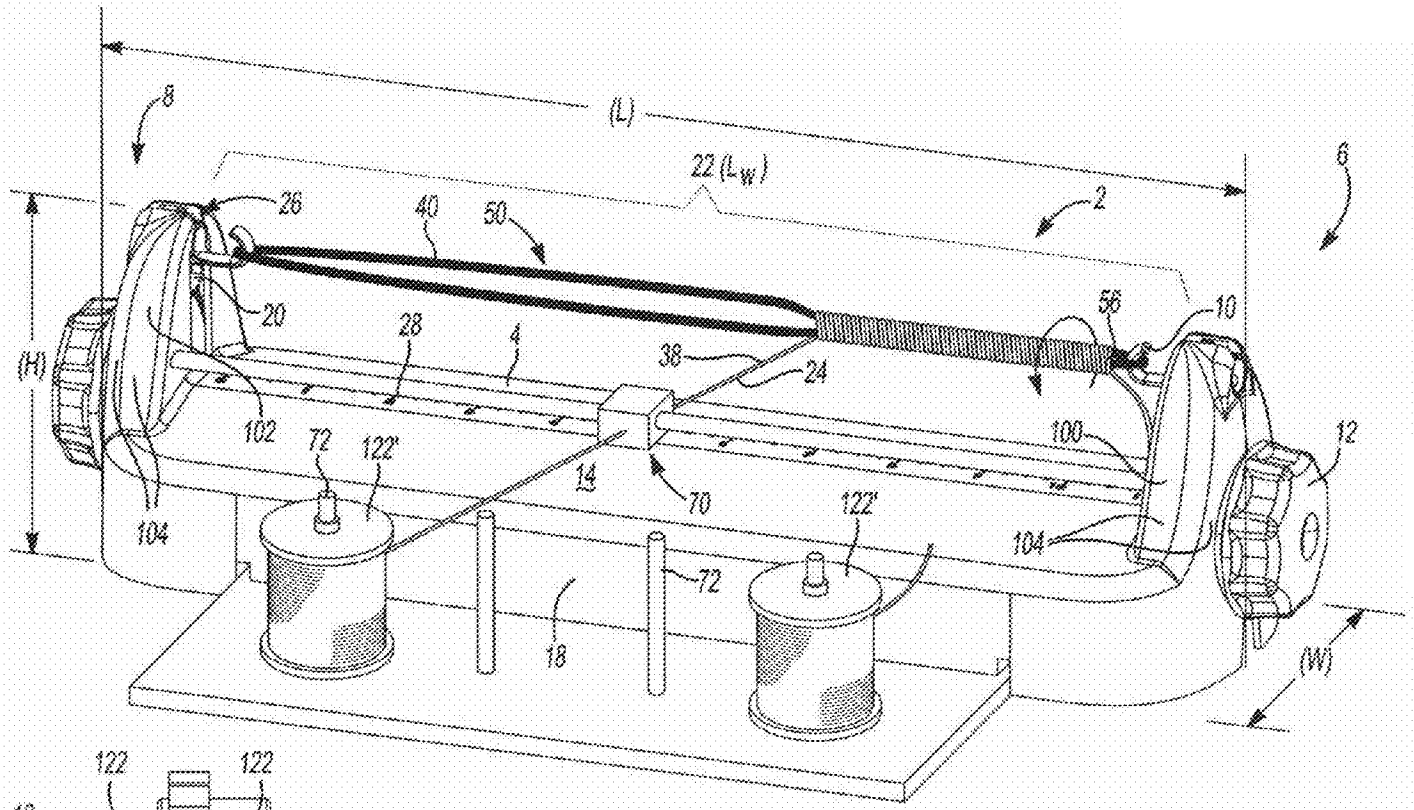
FIG. 1 illustrates a perspective view of one embodiment of the present teachings.

The following description of the preferred embodiment(s) is merely exemplary in nature and is in no way intended to limit the teachings, its application, or uses.

The present teachings are predicated upon providing an improved device for creating articles. The present teachings assists young children in creating unique articles such as fashion accessories quickly and efficiently so that they do not become frustrated and/or lose attention. The present teachings further teach a device that withstands lateral forces and especially lateral displacement of parts by actions such as dropping, banging, hitting, and normal use conditions.

The present teachings relate to a device for creating unique customized articles, preferably fashion accessories, and more preferably jewelry. The device includes a body portion including with a first end region and a second end region spaced apart from the first end region. Each end region includes an outwardly projecting support. The outwardly projecting support may be at an end of the body or located a distance from the end. The outwardly projecting support includes a holder defining a spacing therebetween so that a flexible medium may be located between the holders. The device includes a plurality of inter-meshing gears on at least one side. Preferably, the gears include a gear ratio so that one rotation of the gears causes the holder to rotate one or more times. The device includes at least one structure for preventing translation (i.e. movement of the interconnected parts of the device). Preferably, the at least one structure for preventing lateral translation is located in close proximity to the inter-meshing gears so that the gears are held in alignment and are laterally stable. The rotation device is in rotatable driving relation with at least one of the holders and the plurality of inter-meshing gears so that upon rotation of the rotation device causes the holder to rotate one or more times. The spacing of the holders is sufficient so that when an elongated strand of a flexible filament is removably attached to each of the holders, a core with a longitudinal axis is defined, and the core is in a state of tension. The core may span between the holders without being in tension. For example, the core may be loosely or slackly connected to both holders. The rotation device is such that at least one holder is rotated generally about the longitudinal axis of the core while a predetermined length of a filament that is either completely unattached to a holder or is preferably attached to one holder is fed generally tangentially to the core thereby forming a series of consecutive adjoining loops around the core.

The present teachings include a body portion. The body portion may be of any size and shape so that fashion accessories may be created using the device. The body portion may be thin, wide, long, short, adjustable, fixed; one piece, multiple pieces fixedly attached together, one or more pieces that may be assembled so that one or more holders of the device are substantially aligned, or a combination thereof. The device may include a space and/or gap between the first end and the second end. The body portion may have a first end and a second end. The body portion may be of any size and shape so that the first end and the second end secure holders in place. The first end and the second end may be generally coplanar so that a piece of flexible medium may be extended between the first end and the second end. The first end and the second end of the body portion may form a working plane. The first end and the second end may define a working area between the first end and the second end. The body portion may include a first end region and a second end region. The end regions may be 10 percent or more, 20 percent or more, or even 30 percent or more of the total length of the body. The end regions may be 50 percent or less, 45 percent or less, or 40 percent or more of the total length of the bogy portion. The body portion may have a length. The length of the body portion may be any length so that fashion accessories may be created by the device. The length of the body portion may be set and/or fixed (i.e. not adjustable). The length of the body portion may be adjustable (e.g. the first end and the second end may be moved closer and/or further apart so that different length fashion accessories may be created). For example, the body may be adjusted to one length to create a bracelet and another length for a necklace. Any device that allows the length to be changed may be used in the device so that the length may vary. It is contemplated that the other parts of the device may be adjustable so that they move as the device moves. For example, the device may include a system that allows all of the components to move in unison so that the length may be adjusted. A cam lock system may be used to adjust the length. A telescope system may be used to adjust the length. The length of the body portion may be about 10 inches or more, about 15 inches or more, or about 20 inches or more. The length of the body portion may be about 30 inches or less, about 26 inches or less, or about 24 inches or less. The length of the body portion as described/herein may vary by about ±10 percent, about ±20 percent, or about ±50 percent. The body portion may have a height. The height of the body portion is the dimension measured for the bottom side of the body to the highest point of the body (e.g. from a table to the point farthest from the table). The height of the body portion may be about 5 inches or more, about 7 inches or more, or about 10 inches or more. The height of the body portion may be about 18 inches or less, about 15 inches or less, or about 12 inches or less. The body portion may have a width. The width may be of any size so that fashion accessories may be created. The width may be about 4 inches or more, about 6 inches or more, or about 8 inches or more. The width may be about 15 inches or less, about 12 inches or less, or about 10 inches or less.

The body portion may include an external shell and an internal component. The external shell may substantially surround the internal component. For example, the internal component may have a shape substantially similar to that of the external shell and may enter the external shell and form a base of the body portion that the external shell rests upon. The internal component may have substantially the same components described herein for the external shell, the body portion, or both. For example, both the external shell and the internal component include outwardly projecting supports. The external shell and the internal component when connected may form a body portion. Preferably, the internal component substantially mirrors the external shell so that the internal component fits into the external shell and the two parts connect forming a body portion. The external shell and the internal component may be connected using snaps, locking tabs, screws, glue, a friction fit, an interference fit, or a combination thereof.

The device may be one unitary piece. The device may be free of an internal component. The device may include only an external shell and one or more of the components discussed herein for the internal component may be incorporated into the external shell. The structures may be part of the device. The device may include hinges. The device may include quick release parts so that the device may be taken apart quickly and put back together quickly. The device may fold so that it may be stored, transported, moved, or a combination thereof easily. The device may include an attachable handle. The device may include an integral handle. For example, a piece of the device may be functionally used as a handle in addition to being used as the body of the device. The device may include a cover, a carrying case, the device may be the carrying case, or a combination thereof.

The device may include an outwardly projecting support at the first end, the second end, or both ends. The device may include an outwardly projecting support in the first end region, the second end region, or both regions. The outwardly projecting support may project laterally out. For example, the outwardly projecting structure may project in a direction parallel to a platform of the device. Preferably, the outwardly projecting structure may project vertically out. For example, the outwardly projecting structure may project out away from the platform so that the outwardly projecting structures form substantially a right angle with the platform. The outwardly projecting support may include a height. The height of the outwardly projecting support may be any height so that a loose flexible medium may be wrapped around a support to create an article. The height may be a height of about 1 cm or more, preferably about 5 cm or more, or even about 10 cm or more. The height may be about 40 cm or less, about 35 cm or less, or about 30 cm or less. The height of the support may be adjustable. The height of the support may extend the height of the support by about 10 percent or more, about 20 percent or more, about 30 percent or more. The support may be collapsible (e.g. the support includes a hinge so that the support is folded into the body of the device). The support may be movable. The support may be located on a track. The supports may be moved within the regions so that the supports are moved to create tension on the flexible mediums. The outwardly projecting supports may include, be located near, or adjacent to at least one structure for preventing part translation.

The structure for preventing translation may be any structure that prevents the gears, holder, translation rod, rotation knob, or a combination thereof from moving and/or losing alignment during use, an impact (latitudinally, longitudinally, diagonally, or an angle therebetween), in a worn condition, or a combination thereof. The structures may be part of the external shell, the internal component, or both. Preferably, the structures are part of the internal component. More preferably, the outwardly projecting supports of the internal component include structures for housing one or more of the moving parts. The device may include one or more structures that provide stability to the moving parts. For example, the device includes walls that prevent the gears from becoming misaligned (latitudinally, longitudinally, diagonally, or an angle therebetween). The device may include one structure for preventing translation. Preferably, the device includes at least one structure in each end zone. More preferably, the device includes two structures in each outwardly projecting support. Most preferably, the structures prevent movement and/or disalignment of the gears. The structure may prevent the parts from moving laterally, longitudinally, or any angle therebetween. The structures may be used in tandem so that the gears are sandwiched between the structures so that the gears do not lose alignment or communication. The structures may substantially encapsulate one or more of the gears so that the gears are maintained in alignment. The structures may include one or more cradles. The structures may include a cradle for each gear. The cradle may hold a portion of one or more of the moving parts (e.g., a projection from a gear or a rotation device). The cradle of the internal component, the external shell, or both may be "U" shaped or include a "U" shaped portion; "C" shaped, "O" shaped, or a combination thereof so that the gears are held in place by the cradle. The internal component may have a cradle and the external shell may have a cradle that match each other so that when they are put together they hold the moving parts. For example, the two cradles when put together may form a complete circle and substantially surround a projection of a moving part. The structures may provide some movement of the moving parts so that during the structures do not create friction so that it becomes increasingly difficult for the user to rotate the moving parts. The structures may be made of the same material as the body, the gears, or any other part of the device. The structures may be an integral part of the body and may be permanently connected to the base of the body portion. The structures may be located and covered by the outwardly projecting supports of the external shell. However it is contemplated that the structures may be located outside of the outwardly projecting supports. The supports and/or the structures may include a channel, form a channel, or both.

The channel may be any configuration, shape, size, or a combination thereof so that unfinished medium (i.e. individual strands of flexible medium), finished medium (i.e. a core of flexible medium with at least one non-attached medium looped around), or both may extend outside of the work area. The channel may be one size. The channel may include an axis of rotation. The channel may be parallel to an axis of rotation of one or more of the gears. The channel may pass through, be accessed through, or both one or more of the gears forming a split in the gear so that one or more flexible mediums may pass through the split gear. The channel may prevent entanglement of flexible mediums not in use and may provide an easy, fast, convenient way, or a combination thereof to alternate between flexible mediums during the creation process. Preferably, the channel may be located substantially along the axis of rotation of the core. The channel may include an axis of rotation. The channel may be parallel to an axis of rotation of one or more of the gears. Preferably, the channel may be located substantially along the axis of rotation of the core. More preferably, the channel may extend through one or more split gears and one or more outwardly projecting supports. The size of the channel may be large enough in order to accommodate a plurality of pieces of flexible medium. The channel may be sized to accommodate virtually any quantity of flexible medium. For example, the channel may be sized to fit about 10 pieces or more, about 100 pieces or more, or even about 1000 pieces or more of flexible medium. It is contemplated that each piece of flexible medium may be comprised of one or more flexible mediums (i.e. between about 5 and 50 pieces of flexible medium, preferably between about 7 and 25 pieces of flexible medium, and more preferably between about 10 and 15 pieces of flexible medium). The size of the channel may vary (i.e. may be made larger or smaller in order to accommodate more or less flexible mediums). The size of the channel may have a largest dimension of about 0.5 cm or more, about 1 cm or more, about 2 cm or more, or even 5 cm or more. Most preferably, the size of the channel is between about 5 mm and 15 mm (i.e. about 10 mm. The size of the channel may have a largest dimension of about 10 cm or less, about 8 cm or less, or preferably about 6 cm or less. The first end, the second end, or both ends may include a device that may allow the flexible material to be placed outside of the body portion so that it is not located in a work area and then when needed the excess material may be moved into the work area (i.e. the area between the holders) and/or the finished material may be moved outside of the work area. The first end, the second end, or both ends may include any device, hole, gap, lack of material, or a combination thereof that allows all or a portion of the flexible mediums to extend outside of a working area (e.g., an area between the first end and the second end). The channel may include a flexible medium holding device.

The flexible medium holding device may be any device and/or feature that holds the flexible mediums so that they are held out of the working area. The flexible medium holding device may be any device that holds the flexible mediums so that they do not tangle during use. The flexible medium holding device may be any device that assists in creating fashion accessories. The flexible medium holding device may be any device that prevents the flexible mediums from moving out of the channel so that they do not become tangled into the gears, translation rods, any other moving parts, or a combination thereof. Preferably, the flexible medium holding device may part of the split gear. For example, the flexible medium holding device may span across all or a portion of the one or more channels so that flexible mediums are retained in the channels. More preferably, the flexible medium holding device may allow flexible mediums to be placed and held in the channel of the split gear and the outwardly projecting support so that during rotation of the split gear the one or more flexible mediums are maintained within the channel and out of the work area. The flexible medium holding device may prevent entanglement of flexible mediums not in use and may provide an easy, fast, convenient way, or a combination thereof to alternate between flexible mediums during the creation process The flexible medium holding device may be attached to the device. The flexible medium holding device may be a separate piece (i.e., removable). The flexible medium holding device may move with the holders. The flexible medium holding device may move a plurality of directions. The flexible medium, holding device may be movable in 2 axes or more, 3 axes or more, 4 axes or more, or even 5 axes or more. For example, the flexible medium holding device may move up and down; side to side; forward and backwards, diagonally; or a combination thereof. The flexible medium holding device may be attached at one end, a separate piece at one end, or both. The flexible medium holding device may be made of any material that assists in creating fashion accessories.

The flexible medium holding device may be made of metal, plastic, a polymer, a natural material, cloth, rubber, or a combination thereof. Preferably, the flexible-medium holding device may be made of rubber, delrin, polypropylene, the same material as the split gear, or a combination thereof. The flexible medium holder may be a cam (i.e. a one way pulley), a clamp, a snap, a pin, a flap, a clip, a swivel hook, a snap swivel, a lever, a feature, a hinged feature, a hook and loop fastener, foam, or a combination thereof. Preferably, the device may include both a flap and/or a tapered pin to hold the completed portion, the uncompleted portion, excess portions, or a combination thereof. Most preferably, the flexible medium holding device is a series of flaps in combination that flex so that flexible mediums may be placed and/or removed from the one or more channels. The flexible medium holding device may resist entry and/or exit of the one or more flexible mediums from each channel. Preferably, the flexible medium holding device requires enough pressure so that the flexible mediums are maintained in place, during use, but no so much pressure that young children are prevented from placing flexible mediums in the channels. The flexible medium, holding device may have one or more parts that extend from each side of the channel towards the opposing side of the channel. The flexible medium holding device may have a gap between the opposing parts. The opposing parts may extend so that the parts are substantially in contact with one another. The flexible medium holding device may include a housing. The housing may be any device that holds completed portions, uncompleted portions, excess portions, or a combination thereof. Preferably, the housing prevents the portions from becoming tangled, twisted, or knotted, during use of the device. The housing may be a device that wraps up the portions and rotates as the device is being used. The housing may contain the portions. Preferably, the housing is located proximate to the channels so that the material passes through the channel into the housing. The housing may be a pocket. The body portion may be free of a platform. Preferably, the body portion may include a platform.

The platform may be of any size and shape so that a fashion accessory may be created. The platform may be any platform that assists the user in making fashion accessories. The platform may be dimensionally the same size as the body portion. The platform may be ±5 percent or ±10 percent of the dimensions recited here for the body portion so that the body portion is dimensionally the largest part of the device. The platform may be one solid piece. The platform may be constructed of one or more pieces that are connected. The platform may include hinges so that a plurality of pieces may be connected together to form the platform. The width of the platform may be less than the width of the body portion. The platform may be wider than the body portion. The platform may be one unitary piece with the device. The platform may be a separate piece. The platform may be removable. The platform may be permanent. The platform may be flat. The platform may be contoured. The platform may include ergonomic features (e.g. a ramp, a slope, a wrist rest, a guide, the like, or a combination thereof). The platform may be situated so that a user may rest a hand on the platform while the user is making a fashion accessory. The platform may be contoured on one side and flat on the opposing side. The platform may be substantially flat and include anchors so that another device may be removably attached to the platform. For example, an ergonomic feature may be attached and removed so that it assists in protecting the user from ergonomic injuries, but may be moved to accommodate both a left and right handed user. The platform may cover a space.

The space may be any size and shape so that a fashion accessory may be created. The space may be free of other portions of the device (e.g. a platform, gears, translation rods, the like, or a combination thereof). The space may include storage space. The storage space may be of any size and shape so that flexible mediums may be stored in the storage space. The storage space may include a drawer. The drawer may be movable. The drawer may be moved out of the device on either side so that the device does not have to be reoriented to access the drawer. The drawer may be entirely removed from the device. The drawer may be moved in and out of the space by the user. The drawer may include separate chambers. The drawer may include a lock so that the drawer may be locked in the device while the device is not in use. The lock may be any lock that holds the drawer in the device. The lock may be made of the same material as the drawer, the device, or both. The lock may be an integral feature of the drawer. The lock may be a rib, a catch, a bump, a detent, or a combination thereof so that the drawer resists being removed. The lock may be made of a different material than the drawer, the device, or both.

The ergonomic features may be a one size fits all feature. The ergonomic feature may be adjustable. For example, the height of a feature (e.g. ramp, rest, guide, etc . . . ), angle of a feature, length of a feature, or a combination thereof may be adjustable to accommodate different sized users. The ergonomic feature and the platform may be separable pieces. The ergonomic feature and the platform may be one unitary piece. The ergonomic feature may be made of the same material as the platform, body, or any other material discussed herein. The ergonomic feature may include cushioning. The cushioning may be fabric, foam, leather, vinyl, cotton, or any other soft fabric so that it is comfortable for the user to rest his or her arm and/or hand on the feature.

The device includes holders. The device may include one holder. Preferably, the device may include two holders. More preferably, one holder may be located in a first end region of the device and the other holder may be located in the second end region of the device, and the holders are open so that a flexible medium may be added to the holder without moving any parts of the holder. Most preferably, the holder is not a chuck or similar device that requires the user to open and close in order to clamp the one or more flexible mediums. For example, the holder is free of moving parts that grip and/or clamp the one or more flexible mediums (i.e. radially movable jaws). The holder may be free of a rigid continuous circular space that requires a user to navigate the one or more flexible mediums through the space so that the one or more flexible mediums may be placed outside of the work area and/or attached to the holder. The holder may be free of an opening so that one or more flexible mediums may pass through the holder. The holder may be free of direct attachment to a tube (i.e. the holder is not mounted to a hollow tube so that the axis of the holder passes through the tube). The holders may be coplanar. The at least one holder may be of any shape and size so that the holder may attach to a flexible medium so that a fashion accessory may be created. The holder may be large enough so that a plurality of strands of flexible medium may be placed in and/or on the holder. For example, the holder may hold 2 stands or more, 5 stands or more, 10 stands or more, or even 15 stands or more. It is further contemplated that the holder may hold 10 strands, 100 strands, 1000 strands, or even 10,000 strands of flexible medium. The holder may hold 50 strands or less, 30 strands or less, or 20 strands or less. The holder may allow for strands to be placed in the holder multiple times. For example, the strands may be placed in one holder then extended to the other holder and then back to the first holder and so on until the desired core thickness is achieved. As discussed herein each strand of flexible medium may be comprised of multiple individual flexible mediums combined together.

The holder may be any device that holds a flexible medium in place. The holder may be any device so that a flexible medium may attach to the device in order to create a fashion accessory. The holder may be a hook, a clamp, loop, any other device that may hold a flexible medium, or a combination thereof. The holder may be "J" shaped, "U" shaped, "C" shaped, "O" shaped, "O" shaped and hinged, or a combination thereof. If a hinge is used the unhinged portion (i.e., the movable portion) may be held in place by a snap, a lock, a magnet, or some other feature to retain the holders shape during use. The holder may be fixed. The holder may be rotatable. The holders may be removable. The holders may be movable is a plurality of directions. The holders may be movable in 2 axes or more, 3 axes or more, 4 axes or more, or even 5 axes or more. For example, the holders may move up and down; side to side; forward and backwards; diagonally; or a combination thereof. The holder may be fixedly attached to a rotatable portion of the device. Both holders may be fixed. One holder may be fixed and one holder may rotate. Preferably, both holders may rotate. One holder may be driven and one holder may freely spin. Preferably, both holders may be driven. More preferably, two holders may be used and the two holders may be connected by a translation rod. The holders may include a lock. The holder may include any device that may close the holder so that the flexible mediums may not be removed before use, during use, or after use. For example, the lock may be a pin, a piece that slides over the holder, a clasp, a rotation knob, the like, or a combination thereof. The holders may be open assisted, closed assisted, or both. The holders may be spring loaded.

The holders may be laterally and longitudinally fixed and radially movable. For example, the holders may remain stationary relative to the outwardly projecting support, body portion, or other gears, and may rotate around an axis. The holders may move closer and further together and the length of the device may remain fixed. Preferably, a distance between the holders is set so that a standard length article (e.g., a bracelet) may be made without having to move the device and/or any flexible mediums. The holders may be positioned on an extension rod. For example, the extension rods may extend into the working, area so that the distance between the holders may be reduced and tension may be created on the flexible medium. The extension rods may extend into the work area different distances. For example, the extension rods may extend into the work area about 1 cm to create one fashion accessory and 5 cm to create another fashion accessory. The extension rods each may extend about 1 cm or more, about 2 cm or more, or about 3 cm or more into the work area from its respective end. The extension rods may extend about 10 cm or less, about 8 cm or less, or about 6 cm or less into the work area from its respective end. The holders may not include a shaft between the holder at the first end and the holder at the second end. The holders on both ends may be adapted to receive a second core. The holders may be adapted to receive a second core during looping so that both cores are fixedly attached to the device. The holders may include a biasing member. The biasing member may be any member that assists in creating tension on the one or more flexible mediums. The biasing device may be any device that moves the holders laterally so that the holders assist in creating tension on one or more of the flexible mediums. The biasing members may be a spring, a crank, a screw, a ratchet, or any other device that assists in tensioning the flexible mediums.

The device may be free of a shaft. The device may be free of direct connection between the holders. The holders may only be connected by a flexible medium. The device may be free of a shaft that the medium may be wrapped around. For example, the device may not include any device that spans between the two ends that assists and/or is used to make fashion accessories. The device may be free of a rod that is cantilever and used to assist in making fashion accessories. The device may be free of any device and/or part, other than a flexible medium itself, that the flexible medium may be wrapped around in order to create a piece of fashion accessory.

The translation rod may be of any shape and size so that the translation rod assists in making articles and/or fashion accessories. The translation rod may span from the first end region to the second end region. The device may be free of a translation rod. Both ends of the device may rotate individually. Preferably, the translation rod spans from the first end region to the second end region and connects to a gear, a cog, a rotation device, or a combination thereof. More preferably, the translation rod may be attached to the largest gear at both ends. The translation rod may be free a direct or indirect connection to holder via a drive chain. The translation rod may span from the first end to the second end so that both ends rotate simultaneously. Preferably, the translation rod rotates both ends of the device simultaneously and at the same rate of rotation so that the flexible medium does not become twisted. The translation rod, the first end, the second end, or a combination thereof may include an engagement mechanism so that the translation rod, the first end, the second end, or a combination thereof may be engaged and/or disengaged. The translation rod may be driven by a rotation device. The translation rod may form a plane and/or an axis. The translation rod may be located parallel to the axis of the gears. The translation rod may be axially aligned with one or more gears. The first end, the second end, or both ends may move along this plane and/or axis of rotation so that the device may be made longer and/or shorter. The translation rod may be telescoping, may include one or more removable/addable pieces so that the length may be varied, or both so that the length of the translation rod may be moved to a desired length. For example, the translation rod may be changed to have a length between about 6 inches and 3 feet. The translation rod may be free of view during use. The translation rod may be located below a platform of the body. The translation rod may be located inside of the body portion, but visible due to a transparent material being used for the body portion. The translation rod may be located inside of the platform so that during use the flexible medium does not contact the translation rod.

The rotation device may be any device that allows and/or assists a user in rotating one or more pieces of the device so that a fashion accessory may be created. The rotation device may be a roller ball, a lever, a handle, a foot petal, the like, or any combination thereof or any other configuration that would be activated by twisting, sliding, pushing, pulling, turning, or a combination thereof. The rotation device may be a hand crank. Preferably, the rotation device may be a knob so that a user runs her hand over the knob in order to rotate the device. The rotation device may be manual (i.e. the user rotates the device). The rotation device may be automated (e.g., a motor). The rotation device may store energy. For example, the rotation device may be rotated, and then subsequently the stored energy may be released so that the holders rotate the flexible medium and a fashion accessory may be created. It is contemplated that a motor and/or energy storage device may include a button, lever, foot pedal, the like or a combination thereof to initialize rotation of the device. The rotation device may be any device So that the device may be used ambidextrously. The device may be used ambidextrously so that a looping design may be made in a first direction and then a second looping design may be made in a second direction partially covering the looping design creating a new looping design. The rotation device may be any device so that the device does not have to be moved, the user does not have to move, or both so that the device may be used to create a fashion accessory without having to reorient the rotation device with the user or vice versa. The rotation device may rotate the holders by being connected to and/or rotating any part of the device. For example the rotation device whether manual or automated may rotate a gear, cog, wheel, pulley, the translation rod, or a combination thereof. Preferably, the rotation device may be attached to gears, cogs, wheels, pullies, the like, or a combination thereof so that as the rotation device rotates the at least one holder is rotated.

The device may include one or more gears. The device may include gears at the first end, the second end, or both ends. The device may include any gear so that the rotation device may rotate the holder. The gears may be inter-meshed. For example, there may be two or more gears that are in communication so that when the rotation device is rotated the holder rotates. A plurality of gears may be inter-meshed. The gears may be located in and/or between structures so that the gears are maintained in contact, alignment, a driving relationship, or a combination thereof. The gears may be connected. The gears may be vertically stacked. The gears may be off-set. For example, the centers of the gears may not be vertically aligned. The gears may be of the same size. The gears may be of different sizes. The gears may include step down gearing. For example, the gear connected to the rotation knob may be larger than the gear attached to the holder so that one rotation of the rotation knob rotates the holder a plurality of times. Preferably, the device will include one large gear and at least one smaller gear so that rotation of the large gear will rotate the small gear multiple times. For example, the device may include one large gear and two smaller gears, the gears may have a ratio of rotation of the large gear to the small gear. For example, for every rotation of the large gear the small gear may rotate about 3 times or more, about 5 times or more, about 7 times or more, about 10 times or more, or even about 15 times or more. The large gear may rotate the small gear about 50 times or less, about 30 times or less, or about 20 times or less. The gears may be solid (i.e. include teeth around the entire circumference). The gears may include a portion free of teeth (i.e. a portion of one or more gear may not include teeth). Preferably, the device may include three gears so that the third gear rotates in the same direction as the first gear. For example, the holder rotates in the same direction as the user's hand. More preferably, the device may include four gears so that the fourth gear rotates in the same direction and the first gear. For example, the fourth gear may be a split gear and a second and third gear may be used so that the fourth gear is always in contact with the second gear, the third gear, or both gears. The one or more holders may be removably connected to one or more gears. The one or more holders may be fixedly connected to one or more gears. The holder and the gear may be one unitary piece. Preferably, the holder is connected to a split gear (i.e. a gear that does not have a full circumference). The gears may include a projection.

The gears may include a projection in each side. The projections may rest upon a cradle of one or more structures. The projection and the gear may be one unitary piece, may be separate pieces, or both. The projection may be used as a bearing (i.e., the gears rotate around, and/or on the projection). One or more gears, the rotation device, translation rod, or a combination thereof may be in communication so that the one or more gears, the rotation device, the translation rod, or a combination thereof stabilize each other (e.g., rotational stability, radial stability, axial stability, or a combination thereof). Preferably, the projection of the rotation device connects the rotation device to a gear and the translation rod so that the components move together and remain in alignment. The projection may be used to connect a gear to a rotation device. The rotation device may include a projection and the projection of the rotation device may connect with a female portion of a gear. The translation rod may extend through a female portion of a gear and into a female portion of a rotation device so that the translation rod, the gear, and rotation device are all in communication. Preferably, the rotation device includes a projection that extend through a female portion in a large gear and the translation rod connects to the rotation rod via a female portion in the projection. One or more projections, the translation rod, or both may extend through a structure of the internal component so that a gear, a translation rod, a rotation device, or a combination thereof are in communication and the holders are rotated.

The device may be free of gears (i.e. the holder is directly attached to the rotation device and the holders are directly driven by the rotation device). The device may be driven by a belt, a chain driven, gear driven, directly drive, indirectly driven, screw driven, any type of drive mechanism that may turn the holders, or a combination thereof.

The body portion may be free of legs (e.g. the body portion may rest directly on a platform, table, a piece of furniture, the floor, a lap, the like, or a combination thereof). It is contemplated that the device may be hand held and the body portion may including a holding portion. Preferably, the body portion may include a base portion. For example, the base portion may be any portion of the base that contacts a surface discussed herein. The body portion may include legs. The body portion may include one or more legs. Preferably, the body portion includes a plurality of legs (e.g. 2 legs, 4 legs, or more). The legs may be a standard height. The legs may have an adjustable height. The legs and/or bottom of the body may include a non-slip surface (e.g. a coating, film, layer, the like, or a combination thereof). The legs and/or bottom of the body may use any non-slip surface that prevents the device from moving during use. For example, the bottom of the legs and/or bottom of the body may include a piece of rubber, a polymeric material, a rough material, the like, or a combination thereof. The base portion may be weighted. The base portion may be free of added weight. The base may include a hole so that weight (e.g. sand, water, the like, or a combination thereof) may be added by the user. The base portion may include a suction cup device for attachment to a surface. The base portion may include a clamp for attachment to a table or another platform.

The device may include a loop assist device. The loop assist device may assist the user in guiding the non-attached flexible medium so that fashion accessories may be made. The loop assist device may be any device that assists in guiding non-attached mediums so that fashion accessories may be made. The guide assist device may be stationary, permanently attached, removable, or a combination thereof. Preferably, the guide assist device may travel the length of the work area so that the guide assist device may assist in creating loops along the entire length of the work area so that fashion accessories may be made. The loop assist device may be stationary and the working pieces of flexible medium may move so that the loop assist device guides the non-attached flexible medium around the work mediums in order to create a fashion accessory. It is further contemplated that the loop assist device may loop the non-attached medium while the user simultaneously rotates the work medium and/or moves the work medium (i.e. the non-attached medium does not move relative to the device) so that a fashion accessory and/or fashion accessories may be created in a continuous manner. The loop assist device may loop around a stationary core in order to create loops. For example, the core may be held stationary and the loop assist device may travel around the core applying an unattached flexible medium to the outside of the core along its length. The loop assist device may include a one or more cradles. The cradles may hold one or more individual strands of non-attached flexible mediums. The cradles may each hold one or more spools of flexible mediums so that the flexible mediums do not have to be measured prior to use in the device. The cradles may be stationary. Preferably, the cradles move with the loop assist device.

The device may include a knot assist device. The knot assist device may be any device that assist, simplifies, creates, makes, simulates, or a combination thereof knots. The knot assist device may be located as a permanent part of the device. The knot assist device may be a temporary part of the device. The knot assist device may be fixedly attached to the device. The knot assist device may be removably attached to the device. The knot assist device may use one or more components, of the device. The knot assist device may not use any of the components of the device but may be temporarily attached to the device so that knots may be tied in the ends, middle, at any location, or a combination thereof, of the plurality of flexible mediums, non-attached pieces, the work area mediums, or a combination thereof. The knot assist device may twist a plurality of flexible mediums together so that a knot may be created. The knot assist device may place a separate part (e.g. a knot simulator) on the ends of the plurality of flexible mediums so that they are fixedly held together without, the user having the tie the plurality of ends to together.

A knot simulator may be any device that holds ends of an article together so that the article may be used by the user. One knot simulator may be located on each end. A knot simulator may be located on one end. Both ends of the article may be attached to the knot simulator. The knot simulator may be permanent. The knot simulator may be removable. The knot simulator may be spring loaded. For example, the knot simulator may be a ring, a loop, a carabineer, a clamp, plastic housing with a hole that is spring loaded to clamp, or a combination thereof. In another example, one end may include an integrated loop and the opposing end may include a spring loaded hook to fixedly secure the opposing end to the loop. The knot simulator may be made of any material so that the knot simulator simulates a knot and attaches two or more ends of the article together. The knot simulator may be made of metal. The knot simulator may be made of a deformable material. The knot simulator may be made of a stretchable material. It is contemplated that the knot simulator may be attached to at least one holder and at least one end of the flexible mediums so that when the flexible mediums are attached to the opposing holder the knot simulator will hold the flexible mediums in tension. For example, the knot simulator may be made of a rubber or plastic and may be stretched in order to place the opposing end of the flexible medium on the opposing holder so that once placed on the opposing holder the flexible medium will be in tension. If is further contemplated that the knot assist device during use may provide some flexibility or "give" so that the article and/or item the article is attached to is not damaged if the article is caught on another object. Furthermore, the knot assist device may provide a snug fit on the user, while providing some movement on the user's body (i.e. wrist, neck, ankle, finger, the like, or a combination thereof). The knot assist device may include a method of creating knots. For example, a plurality of ends may be placed through a hole and looped around the holder. The holder may be rotated and the plurality of ends pushed through a hole created when the plurality of flexible mediums are rotated and then pulled tight so that a knot is created.

The device (i.e. body portion, holders, gears, translation rods, any other devices disclosed herein, or a combination thereof) may be made of any material so that the device may be used to make fashion accessories. The device may be made of a flexible material. Preferably, the device may be made of a rigid material. The device may be made of a polymer. The device may be made of a plastic material. The device may be made entirely of plastic. Preferably, the device may be made of Acrylonitrile Butadiene Styrene (ABS), polypropylene, nylon, delrin, metal, wood, or a combination thereof. The device may be made of metal. Preferably, the body portion may be made of ABS or polypropylene. Preferably, the gears may be made of nylon, delrin, polypropylene, or a combination thereof. Preferably, the translation rod may be made of metal. The device may include metal components. The device may be free of metal components. The device may be made of a washable material. The device may be made of a material that may be conformed to an individual user's preferences. For example, the device may be permanently and/or temporarily individualized by a user (e.g., painted, colored, drawn on, stained, marked, or a combination thereof). The material may be permanently marked by one type of marking device and temporarily marked by a different marking device.

The device may be further customized by individuals. For example, the device may have portions that are magnetic so that the user may customize the device by adding magnets. The device may include a portion with a hook and loop fastener so that items may be attached to the device. The device may include portions that are removable so that a different color. design, style, or a combination thereof may be added to the device. For example, the device may include a portion such as the face of a drawer that may be replaced with a design of the user's preference.

The device uses one or more pieces of flexible medium. The flexible medium may be any medium that may be wrapped around itself and then form a loop so that it may be used as a fashion accessory. The flexible medium may be any medium that may be tied in a knot. The flexible medium may be any color. The flexible medium may be any diameter. The diameter of the flexible medium may vary from flexible medium to flexible medium. Pieces of different size, shape, color, material, diameter, or the like may be used separately or in conjunction with each other. The flexible medium may be yarn, embroidery floss, string, thread, a synthetic textile, a natural textile, a synthetic cord, a natural cord, a plastic cord, rope, the like, or a combination thereof. Preferably, the flexible medium may be cotton embroidery floss. In one example, a cord (i.e. thicker flexible medium) may be placed between the first end and the second end and then a thinner flexible medium such as embroidery floss may be wrapped around the cord and one or more pieces of embroidery floss. In another example, a plurality of pieces of thread are placed between the first end and the second end and then one piece of thread is wrapped around the other pieces. More preferably, the flexible medium may not be a wire or a piece of shaped metallic medium. The one or more flexible mediums may be measured before the one or more flexible mediums are attached to the holders. Preferably, the one or more flexible mediums may not be measured before the one or more flexible mediums are attached to the holders.

The device may include a core creating device. The core creating device may be any device that will assist the user in creating a standard length of core material (i.e. one or more pieces put together for non-attached pieces to be looped around) so that a predetermined length of material may be created. For example, one side of the device may include one, two, three, or more molded features so that the user may measure the flexible mediums in order to determine a standard length for a given fashion accessory. The core creating device may be the working area of the device (e.g., the hooks and the area between the hooks). Using the core creating device eliminates the need for the user to pre-measure the one or more flexible mediums before using the device. For example, the user attaches one end of one or more flexible mediums on a holder and wraps the one or more flexible mediums between the holders creating the desired length of flexible mediums and/or core, thus, eliminating the need for pre-measuring the one or more flexible mediums. The length of the flexible mediums needed may be determined by wrapping the flexible medium around the span between the two or more molded pieces one time, two times, or more so that a standard length is created.

The device may include a cutter. The cutter may be any device that will safely cut one or more and preferably a plurality of flexible mediums simultaneously. The cutter may be a slot that the flexible mediums are placed in with a sharp edge so that the flexible mediums are cut. The cutter may be in a location so that a user's finger, hand, clothing or a combination thereof may not fit in the slot and become cut. The cutter may move. The cutter may be stationary. The cutter may include a lock. The lock may be any device such that the user has to open the lock in order to use the cutter. The cutter may require the user to use both hand simultaneously so that the cutter may not injure the user. For example, the flexible mediums are placed in the cutter and the user has to pull a pin with one hand and pull a lever arm down with the other to cut the flexible mediums. The cutter may have a default position of closed so that when not in use the cutter automatically retracts into the device so that the sharp edge is not exposed. The cutter may include a tensioning device so that the flexible mediums are held in tension when they are cut. The cutter may create tension as the cutter is moved (i.e. lowered down unto the flexible mediums).

The device may include a scale to measure the length of the flexible medium or other mediums used with the device (i.e. a length measurement tool). The scale may be a separate part of the device. Preferably, the scale is an integral part of the device. More preferably, a piece of the device includes a scale. For example, the translation rod, the base of the device, the platform, or a combination thereof may include a scale. A scale may be molded into a part of the device.

The device may include a saving device. The saving device may be any device that is placed around the core and unattached strands so that work may be stopped before finishing an article and work may be resumed without affecting the final article. The saving device may clamp, hook, hold, or tension the work in process so that the finished portion does not become undone. The saving device may be temporarily applied. The saving device may be permanently applied. A permanent saving device may be integrated into the article so that it is not visible once the article is completed.

The device discussed herein may be used to create any article that includes a looped design. The device discussed herein may be used to make pieces of fashion accessories. The completed fashion accessory may be used as a necklace, a ring, anklet, bracelet, hair accessory, belt, decoration for clothing, cord, rope, laces (i.e., for crafts, shoes, the like, or a combination thereof), home decor, clothing decor, or a combination thereof. The device may create one or more looped articles that may be used in conjunction with each other in order to create a bigger article. The looped articles maybe connected together. The device discussed herein may be used to create items other than fashion accessories. For example, the device may be used to create a dog leash. The device may be used to create a rug (e.g. coiled, hand knotted, tufted, hooked, flat weave, or a combination thereof). The device may be used to create a basket. A substantially complete article may include a loop at one end. An article may include internal loops in the center of the article for attachment. The internal loops may be located at any location along the length of the article. The internal loops may be of any size. The internal loops may be large enough to hook the article on the holder so that a longer article may be created. The internal loop may be a portion of the article that does not include a piece of free flexible material looped around the core. The internal loop may be used to hang one or more secondary mediums from the article. A substantially complete article may include one or more loose ends at one end. Preferably, the loop and loose ends are on opposing ends of the article. More preferably, the article may be free of metal. The loose ends may be bunched together in one or more groups. Preferably, the loose ends may be bunched together in two groups so that the ends may be tied together so that the device may be attached by a user. Longer articles such as a necklace or belt may include loops the full length of the article. Longer and/or shorter articles may include gaps between loops (i.e. a region that is free of loops so that the core is visible). The device discussed herein may be used to make pieces of fashion accessories by any steps so that a fashion accessory is created when the steps are completed.

If is further contemplated that the device and method herein may be used to decorate. The device may be used to loop one or more flexible mediums around a structure so that the structure is substantially hidden behind the flexible mediums in a decorative covering. For example, one or more cords (e.g., computer cords, speaker cords, earphone cords, the like, or combination thereof) may be looped by flexible mediums so that the computer cords are bunched together in a decorative fashion and the cords are hidden from view behind the decorative loops.

The article created by the device discussed herein includes a core. The core may be any material suitable for looping a flexible medium around so that an article is created. The core is not rigid. Preferably, the core is flexible. More preferably, the core is not able to support its own weight. For example, the core cannot be held at one end so that the core sticks straight out (e.g. cantilever). The core may include one or more flexible mediums discussed herein. The core may be made of the same material as the flexible medium that is looped around the core. The core may be made of a different material as the flexible medium looped around the core. The core may be created by a user. The core may be pre-made. The core may be made of any flexible medium discussed herein. The core may be made from a rubber band, plastic, a woven material, a thin flexible metal material, a rubber, a silicone rubber, cables, wires, cords, a wire filament, or a combination thereof. Preferably, the core is nonmetallic. It is contemplated that the core may also be the unattached portion that is looped around itself so that the article is one continuous piece. For example, a free end of the core may be looped around the attached portion of the core so that an article is created. A pre-made core may include attachment portions at the ends or in end regions so that the core may be attached to the holders without having to tie knots in the flexible medium. A pre-made cord may include attachment portions that may be attached to the holder and then subsequently attach to each other so that the article is securely attached to the user. The attachment portions may be used without tying knots. The attachment portions may include a separate flexible medium that attaches the core to the user. The attachment portions may be loops, holes, grommets, rivets, or any other structure capable of being attached to a holder, a user, or a combination thereof.

A method may include tying a knot into a flexible medium or a plurality of flexible mediums. The knot may become an integral and/or permanent portion of the article. The knot preferably may be located on a core proximate to a loop on the end region; however, the knots may be located proximate to internal loops. The flexible medium may be attached to the device without tying a knot in the flexible medium or a plurality of flexible mediums. One end of one or more flexible mediums may include a tied, knot and one end of one or more flexible mediums may be free of a tied knot. Both ends may include tied knots. Both ends of one or more flexible mediums may be free of tied knots.

A method of making a fashion accessory may include attaching one or more pieces of flexible medium to the one or more holders. A method of making a fashion accessory may include one or more of the steps discussed herein. The flexible medium may be attached to one holder. Preferably, the flexible medium may be attached to two holders. More preferably, the flexible medium may be attached to the first holder then to the second holder and reattached to the second holder so that multiple lengths of the flexible medium span between the first holder and the second holder creating a work area. The step of attaching the flexible medium may include attaching the flexible medium between the first end and the second end a plurality of times until the desired thickness is achieved. The one or more flexible mediums may be placed over a holder for attachment. The method of attachment may be free of a step of opening the holder. The method may be free of a step of closing the holder. The method may be free of a step of placing the one or more flexible mediums in the holder. One or more pieces of flexible medium may be free of attachment to one or both holders (i.e. non-attached or unattached pieces). The unattached pieces may be integrally attached, permanently attached, fixedly attached, loopedly attached, have a knotted attached, or a combination thereof to the core. The method is free of a step of tightening a chuck or any members of a chuck. The method is free of a step of releasing the grip on the core or an ends of the flexible medium.

The rotation device may be rotated so that the flexible mediums between the one or more holders begin to rotate. A non-attached piece of flexible medium may wrap around the pieces of flexible medium spanning the work area (i.e. an area between-the first end and the second end and more preferably an area between the two holders). Unattached and/or non-attached as used herein may be a portion of the one or more flexible medium that is not attached to and spanning between the holders, thus, forming the core (i.e., at least one end of the flexible medium is not attached to a holder so that the flexible medium may be wrapped around the core). For example, a non-attached medium may be unattached to one or both holders and wrapped around the core, thus, creating an article. In another example, one or more flexible mediums may be wrapped around the holder creating a core, and one or more flexible mediums that form the core may extend from one side of the core so that one end of the one or more flexible mediums is free and may loop around the core (i.e., the core and the unattached medium are one continuous piece of thread). The user may guide (i.e. loop) the non-attached piece of flexible medium around the work area medium until the desired length is achieved. The user may loop a plurality of non-attached pieces around the work area mediums a plurality of times. A non-attached piece may be attached to the first holder, the second holder, or both, using one or more of the steps discussed herein. Before, during, or after the non-attached piece is attached to the first holder, the second holder, or both the one or more different flexible mediums may be removed (i.e. unattached) from the plurality of flexible mediums so that they may be looped around the one or more work area mediums. The un-attached flexible mediums may be changed a plurality of times so that color combination, shape, size, style, type of material, the like, or a combination thereof may vary along the length of the fashion accessory. During the step of changing materials one or more knots may be tied in the "old" un-attached piece, the "new" unattached piece, or both. During the step of changing materials one or more loops may be created in the "old" un-attached piece, the "new" unattached piece, or both so that the completed loops do not un-loop. During the step of changing materials the "old" un-attached piece, the "new" un-attached piece, the working medium pieces, or a combination thereof may be tied, looped, hooked, attached, or a combination thereof. During the step of changing materials one or more flexible mediums may be removed from, placed in, placed through, or a combination thereof a channel, a split gear, a flexible medium holding device, of a combination thereof.

The method discussed herein may be performed entirely by the user, entirely by a machine, or a combination therebetween. The user may rotate the rotation device, move the core, loop an unattached portion, hold the unattached portion stationary, twist flexible mediums together, tie knots, or a combination thereof. A device (e.g., motor) may be used to rotate the rotation device, move the core, loop an unattached portion, hold the unattached portion stationary, twist flexible mediums together, tie knots, or a combination thereof. The user and/or the device may interchangeably perform one or more of the steps discussed herein based on the desire of the user. Some possible examples of different combinations are discussed herein. The user may rotate the rotation device with one hand while guiding the un-attached piece with the other hand so that loops may be formed around the working medium to create fashion accessories. A motor as discussed herein may rotate the rotation device while the user guides the un-attached piece along the core. The user may move their hand laterally along the length of the core as the user rotates the core so that the unattached piece loops around the length of the core. It is also contemplated that the user's hand may remain stationary and the core is moved laterally so that the unattached portion is looped around the length of the core. In yet another embodiment, the unattached piece may be held by the device and the device rotates the core while the user manually moves or the device moves the core laterally so that loops are formed around the core. For example, the user manually assists the device in laterally moving the core (e.g. user selects speed). The methods of creating fashion accessories as discussed herein may be performed until a fashion accessory of a desired length is created.

During, the step of creating a fashion accessory the length of the fashion accessory may be measured to determine when the desired length of the fashion accessory is achieved. Once the desired length is achieved the completed fashion accessory piece is removed from the holder at the first end, the second end, or both ends. The method described herein may be free of a step of slipping the looped flexible mediums off of the core. The first end, the second end, or both ends may be knotted, looped, attached, crimped, fused, glued, fixedly held together, or a combination thereof so that the fashion accessory does not become unattached. The first end of the fashion accessory and the second end of the fashion accessory may be tied together. The completed fashion accessory may be used as a necklace, a ring, anklet, bracelet, hair accessory, belt, decoration for clothing, or a combination thereof. Once the ends of the flexible medium are attached one or more secondary mediums may be added to the fashion accessory. One or more secondary mediums may be placed in/on the fashion accessory and/on fashion accessories before or during creation. For example, one or more secondary mediums may be placed over an "old" unattached medium, "new" unattached medium, the entire working area mediums, or a combination thereof. The secondary medium may be any secondary medium that may be used to create the fashion accessory. The secondary medium may be attached to a completed piece of fashion accessory before the ends of the flexible medium are attached together so that they may be worn by the user. A secondary medium may be beads, ordainments, charms, a post, a hook, some other body enlarged in size relative, to the hole through which it passes to resist pull-through, the like, or a combination thereof. One or more of the secondary mediums may be included within and/or around the fashion accessory. A substantially complete article (i.e. fashion accessory or any other article disclosed herein) may be subjected to a second phase of looping. For example, non-attached flexible mediums may be wrapped around the core, and in a second phase additional non-attached articles may be looped around the core and the phase one loops so that at least a portion of some of the phase one loops are at least partially covered by the phase two loops. The method may include a step of twisting the core so that the flexible mediums become intertwined. The method may include a step of twisting one or more unattached flexible mediums together. The method may include a step of looping the twisted unattached flexible mediums around a core, an article that includes loops, or both. The steps of creating a fashion accessory recited herein may vary from fashion accessory to fashion accessory. The steps recited herein may be used virtually in any order. A step as recited herein may be repeated one or more times before beginning a new step.

Another method for creating a fashion accessory and/or fashion accessories may include one or more of the following steps and/or one or more of the steps previously recited herein. The user may measure pieces of flexible material. The method as discussed herein may be free of measuring flexible mediums. For example, any length of flexible medium may be used that spans between the holders, and the length of the article may be changed by adding more material through the channels. These initial pieces of flexible material may become the attached pieces (i.e., the core material), the non-attached pieces (i.e., loop material), or both. The user may tie a knot in one end. A knot simulator may be added to one or both ends of the flexible mediums. A knot simulator may be attached to the holder and then one end of the flexible mediums may be attached to the knot simulator. The user may attach one end of the flexible mediums to a holder. The flexible mediums may be pulled taught. The taught flexible mediums may be attached to the opposing holder. The excess may be placed through one or both channels. The excess may be secured by a flexible medium holding device. The user may begin to rotate the rotation device. The user may begin to loop a non-attached medium around an attached medium (i.e., the core). One end or both ends of the looped medium may be unattached from the holders when a portion of the core has been looped. For example, one or both ends may be unattached when about ¼ or more, ⅓ or more, ½ or more, is looped. One or both ends may be unattached when about ⅞ or less, about ¾ or less, or about ⅔ or less is looped around the core. The finished portion may be moved though the channel. The unfinished portion may be moved through the channel. Both portions may be simultaneously be moved though the channels. The finished portion, the unfinished portion, or both may be held in place by a tapered dowel pin, a clip, clamp, extra piece, or a combination thereof. Adjusting the size of the loops around the core and/or finished loop pieces so that the size of the loops vary. Looping a non-attached piece around a first set of loops in the working area. The non-attached flexible mediums may be moved into the core of flexible mediums and a new non-attached flexible medium may be moved out of the core. The ends of the finished fashion accessory may be tied. The ends of the finished fashion accessory may be tied together. The steps of creating a fashion accessory recited herein may vary from fashion accessory to fashion accessory. The steps recited herein may be used virtually in any order. A step as recited herein may be repeated one or more times before beginning a new step.

It is contemplated that a method as discussed herein may include a step of attaching a second core to the holders. The second core may be added at any step during the methods discussed herein. The second core may include free ends being looped around the first core and the second core simultaneously. It is contemplated that a plurality of cores may be added to the holders at virtually any stage of created an article.

The device as discussed herein may be a kit. The device described herein may be sold in a kit. The device described herein may be included in a kit. The kit may include the device, flexible mediums, secondary mediums, a core, the like or a combination thereof. The kit may further include replacement parts, charms, clips, pins, hooks, clamps, dowels, instructions (e.g. printed or a DVD), carrying case, carrying handle, detachable rotation devices, loop assist devices, cutting devices, knot tying devices, or a combination thereof.

FIG. 1 illustrates one possible configuration of the present teachings. The device 2 includes a body portion 4. The body portion 4 includes a first end region 6 and a second end region 8. The body portion 4 further includes a holder 10 located near the top of a first outwardly projecting support 100 at the first end region 6 and a holder 10 located near the top of a second outwardly projecting support 102 at the second end 8. The first outwardly projecting support 100 and the second outwardly projecting support 102 include two structures 104 for preventing disalignment of the gears 20 and the translation rod 16 relative to the holder 10 and the rotation device 12. The holder 10 is in communication with a rotation device 12 via gears (not shown). The body portion 4 and the top gear 20 include a channel 26 so that one or more pieces of flexible medium (not shown) may pass into the work area 22. The work area 22 has a length ($L_w$). The work area 22 illustrates a partially finished article 50. A guide assist device 70 extends the length of the work area 22 so that the guide assist device 70 assists in creating loops along the length of the work area 22. A flexible medium holding device 122 ' holds a looping flexible medium 38 and the flexible medium holding device 122 ' is held in place by a cradle 72. The article 50 includes a looping flexible medium 38 (i.e., nonattached flexible medium) that is partially looped around the core 40 (i.e., attached flexible medium)'. The core includes a knot 56 attaching the core 40 to the holders 10. The body portion 4 includes a platform 14 and a translation rod(not shown). The platform 14 includes a scale 28. A drawer 18 is located under the platform 14 and the translation rod (not shown). The body portion 4 includes a length (L), a width (W), and a height (H).

Figure 2:
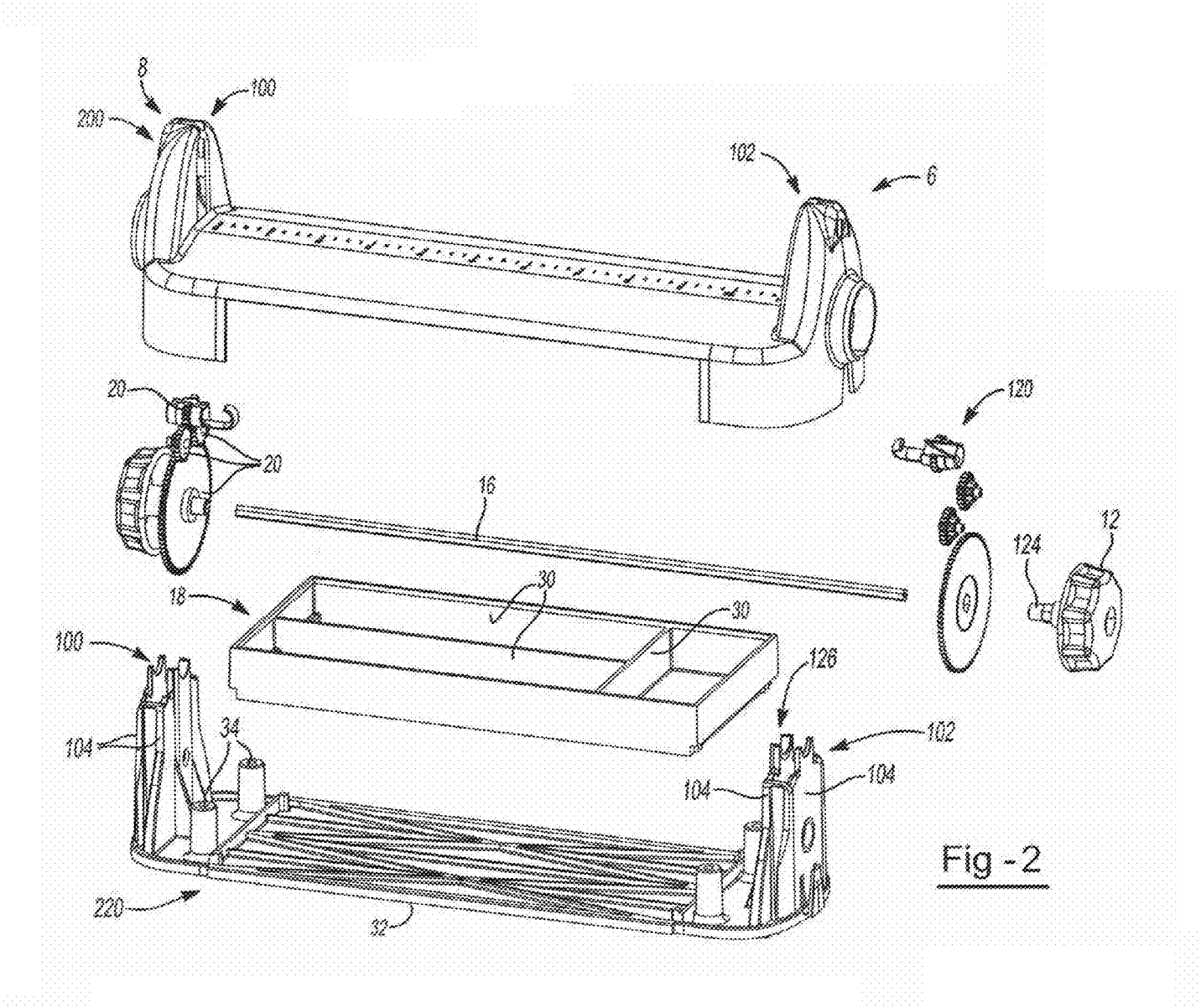
FIG. 2 illustrates an exploded view of one embodiment of the present teachings.

FIG. 2 illustrates an exploded view of the device 2. The body portion 4 includes an external shell 200 and an internal component 220. The external shell 200 includes a first outwardly projecting support 100 and a second outwardly projecting support 102. The drawer 18 includes multiple compartments 30 for storing items in the device 2. The gears 20 are located within and partially surrounded by the structures 104 in each of the outwardly projecting supports 100 and 102 of the internal component 220. The structures 104 of the internal component 220 include cradles 126 for housing the gears. One of the gears 20 as illustrated is a split gear 120. A translation rod 16 is connected to a gear 20 on a first end 6 and a gear 20 on a second end 8 so that the user may ambidextrously use the device and simultaneously turn both ends. The rotation device 12 includes a projection 124 which extends through a hole in a gear 20 and into communication with the translation rod 16. The internal component 220 forms the base 32 of the device 2. The base 32 is flat and includes holes 34 where legs may optionally be included and the base 32 may be attached to the body portion 4.

Figure 3:
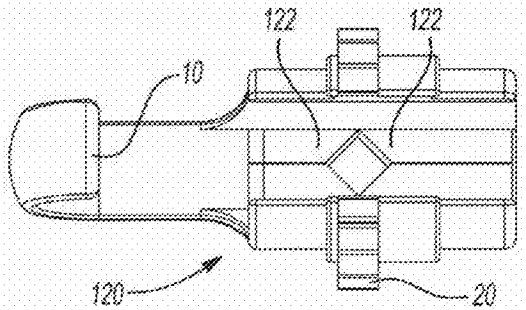
FIG. 3 illustrates a close-up view of a split gear of one embodiment of the present teachings.

FIG. 3 illustrates a close of view of a gear 20 including a channel 26 and a holder 10. The gear 20 is a split gear 120. The split gear 120 as illustrated includes one possible configuration of the flexible medium holding device 122.

Figure 4:
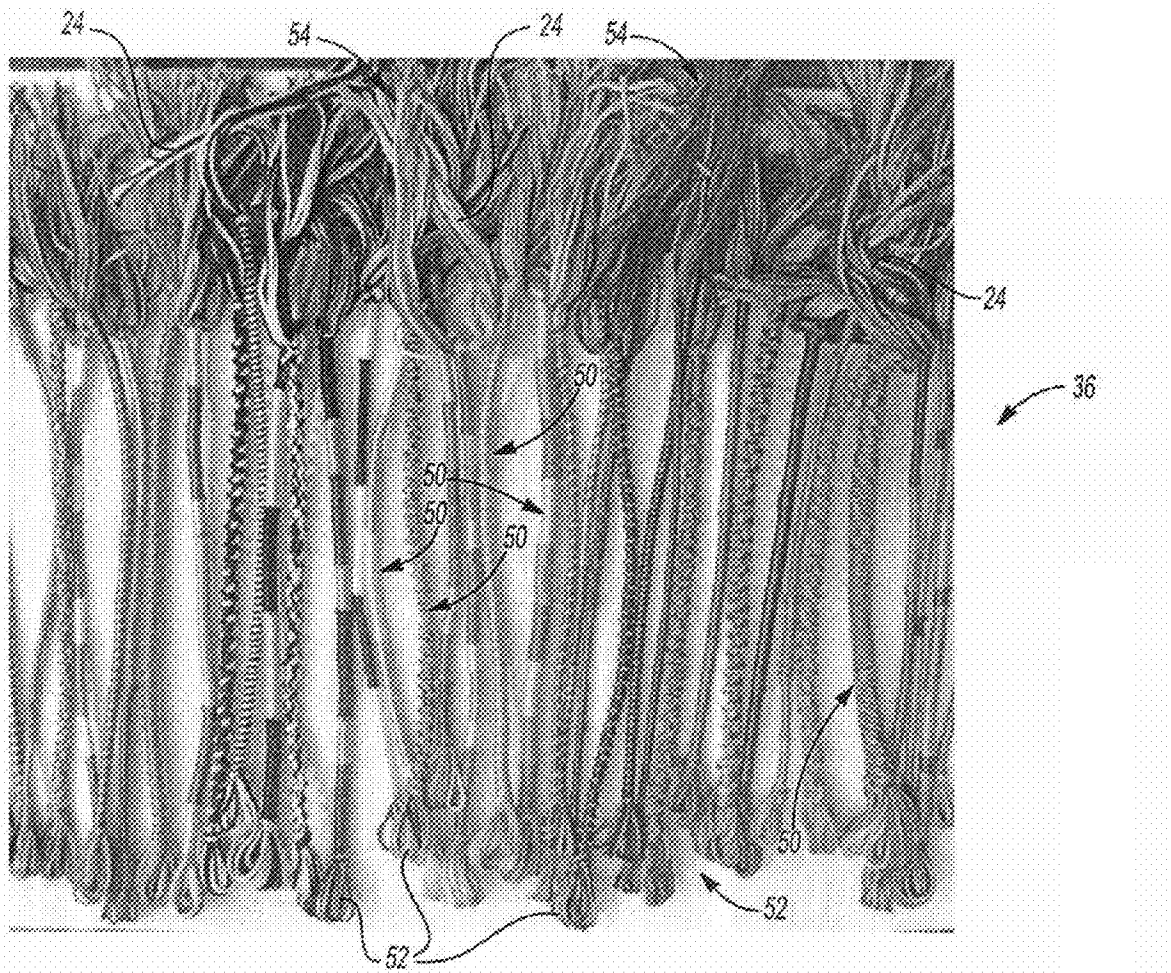
FIGS. 4 and 5 illustrate examples of articles that may be created using the article and method of the present teachings.

FIG. 4 illustrates several examples of articles 50 that are created using the device 2. The flexible mediums 24 can be seen in the article 50 at the loose end 54 and the looped end 52.

Figure 5:
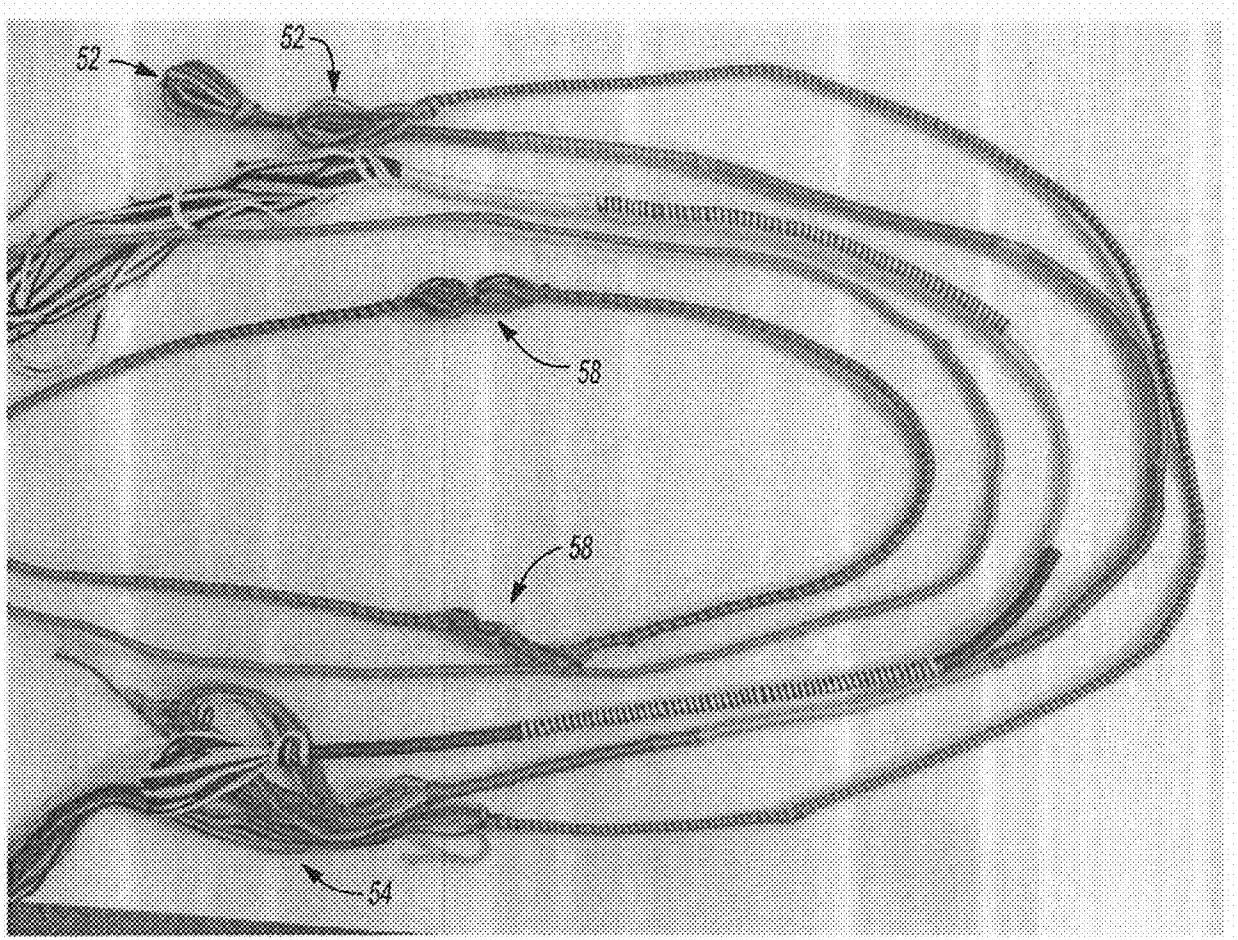

FIG. 5 includes multiple articles 50 that were made using the device 2. The articles 50 include a looped end 52 and a loose end 54. The articles 50 include internal loops 58. The looped end 52 and the loose end 54 are tied together forming a knot 56 and ultimately a fashion accessory 36.

Any numerical values recited herein include all values from the lower value to the upper value in increments of one unit provided that there is a separation of at least 2 units between any lower value and any higher value. As an example, if it is stated that the amount of a component or a value of a process variable such as, for example, temperature, pressure, time and the like is, for example, from 1 to 90, preferably from 20 to 80, more preferably from 30 to 70, it is intended that values such as 15 to 85, 22 to 68, 43 to 51, 30 to 32 etc. are expressly enumerated in this specification. For values which are less than one, one unit is considered to be 0.0001, 0.001, 0.01 or 0.1 as appropriate. These are only examples of what is specifically intended and all possible combinations of numerical values between the lowest value and the highest value enumerated are to be considered to be expressly stated in this application in a similar manner.

Unless otherwise stated, all ranges include both endpoints and all numbers between the endpoints. The use of "about" or "approximately" in connection with a range applies to both ends of the range. Thus, "about 20 to 30" is intended to cover "about 20 to about 30", inclusive of at least the specified endpoints.

The disclosures of all articles and references, including patent applications and publications, are incorporated by reference for all purposes. The term "consisting essentially of" to describe a combination shall include the elements, ingredients, components or steps identified, and such other elements ingredients, components or steps that do not materially affect the basic and novel characteristics of the combination. The use of the terms "comprising" or "including" to describe combinations of elements, ingredients, components or steps herein also contemplates embodiments that consist essentially of or even consists of the elements, ingredients, components or steps.

Plural elements, ingredients, components or steps can be provided by a single integrated element, ingredient, component or step. Alternatively, a single integrated element, ingredient, component or step might be divided into separate plural elements, ingredients, components or steps. The disclosure of "a" or "one" to describe an element, ingredient, component or step is not intended to foreclose additional elements, ingredients; components or steps.

It is understood that the above description is intended to be illustrative and not restrictive. Many embodiments as well as many applications besides the examples provided will be apparent to those of skill in the art upon reading the above description. The scope of the invention should, therefore, be determined not with reference to the above description, but should instead be determined with reference to the appended claims, along with the full scope of equivalents to which such claims are entitled. The disclosures of all articles and references, including patent applications and publications, are incorporated by reference for all purposes. The omission in the following claims of any aspect of subject matter that is disclosed herein is not a disclaimer of such subject matter, nor should it be regarded that the inventors, did not consider such subject matter to be part of the disclosed inventive subject matter.

I claim:

1. A method comprising:

a. obtaining a device for making a bracelet comprising:
   i. a body portion having a longitudinal axis, a first end region and a second end region spaced apart from the first end region;
   ii. a platform on the body portion;
   iii. a first support located at the first end region and projecting outwardly from the platform, the first support having an inner wall and an outer wall;
   iv. a second support located at the second end region and projecting outwardly from the platform, the second support having an inner wall and an outer wall;
   v. a first holder positioned adjacent the inner wall of the first support and being adapted to receive a first end portion of at least one first flexible medium;
   vi. a rotation device positioned adjacent the outer wall of the first support and drivingly coupled with the first holder for causing the first holder to rotate about an axis that is generally parallel to the longitudinal axis of the body portion;
   vii. a second holder opposing the first holder and being adapted for receiving a second end portion of the at least one first flexible medium, the second holder being positioned adjacent the inner wall of the second support and being spaced from the first holder for defining a work area;

b. securing the at least one first flexible medium in the first holder and the second holder forming a core;

c. wrapping the at least one first flexible medium or an at least one second flexible medium around the core;

d. rotating the rotation device to cause winding of the at least one first flexible medium or the at least one second flexible medium in consecutive adjoining loops around the core forming an article; and e. applying a knot simulator, tying a knot, or both in the article at a point along a length of the article so that the article can be used as a bracelet.

2. The method of claim 1, wherein the method includes a step of changing the at least one first flexible medium or the at least one second flexible medium and includes tying a knot in the at least one first flexible medium or the at least one second flexible medium at a point along the length of the core and rotating the rotation device to cause wrapping of at least one third flexible medium, which is different from the at least one first flexible medium and the at least one second flexible medium, in consecutive adjoining loops around the core.

3. The method of claim 1, wherein the first holder and the second holder are indirectly attached by a translation rod so that the step of rotating includes rotating the first holder and the second holder simultaneously using a hand crank.

4. The method of claim 2, wherein the first holder and the second holder are indirectly attached by a translation rod so that the step of rotating includes rotating the first holder and the second holder simultaneously using a hand crank.

5. The method of claim 1, wherein the step of rotating the rotation device includes a step of guiding the at least one flexible medium or the at least one second flexible medium with a guide assist device that is attached to the device and travels a length of the work area.

6. The method of claim 2, wherein the step of rotating the rotation device includes a step of guiding the at least one flexible medium, the at least one second flexible medium, or the at least one third flexible medium with a guide assist device that is attached to the device and travels a length of the work area.

7. The method of claim 3, wherein the step of rotating the rotation device includes a step of guiding the at least one second flexible medium with a guide assist device that is attached to the device and travels a length of the work area.

8. The method of claim 4, wherein the step of rotating the rotation device includes a step of guiding the at least one second flexible medium with a guide assist device that is attached to the device and travels a length of the work area.

9. The method of claim 1, wherein the method includes a step of twisting the at least one first flexible medium or the at least one second flexible medium before the step of wrapping around the core.

10. The method of claim 1, wherein the article has two looped ends, two free ends, or a combination thereof.

11. The method of claim 10, wherein the method is repeated to form a second article, and the second article is connected with the first article.

12. The method of claim 1, wherein the device includes one or more cradles for holding the at least one first flexible medium or the at least one second flexible medium.

13. The method of claim 1, wherein the method includes a step of holding the at least one first flexible medium or the at least one second flexible medium during use with a flexible medium holding device so that the at least one first flexible medium or the at least one second flexible medium is held out of the working area.

14. The method of claim 8, wherein the method includes a step of holding the at least one first flexible medium or the at least one second flexible medium during use with a flexible medium holding device so the at least one flexible medium or the at least one second flexible medium is held out of the working area.

15. A method for making a fashion accessory comprising the steps of:

a. attaching a first end portion of at least one first flexible medium to a device comprising:
   i. a body portion having a longitudinal axis, a first end region and a second end region spaced apart from the first end region;
   ii. a platform on the body portion;

iii. a first support located at the first end region and projecting outwardly from the platform, the first support having an inner wall and an outer wall;

iv. a second support located at the second end region and projecting outwardly from the platform, the second support having an inner wall and an outer wall;

v. a first holder positioned adjacent the inner wall of the first support and being adapted to receive a first end portion of at least one first flexible medium;

vi. a rotation device positioned adjacent the outer wall of the first support and drivingly coupled with the first holder for causing the first holder to rotate about an axis that is generally parallel to the longitudinal axis of the body portion;

vii. a second holder opposing the first holder and being adapted for receiving a second end portion of the at least one first flexible medium, the second holder being positioned adjacent the inner wall of the second support and being spaced from the first holder for defining a work area;

b. securing the at least one first flexible medium in the first holder and the second holder forming a core;

c. wrapping the at least one first flexible medium or an at least one second flexible medium around the core;

d. rotating the rotation device to cause winding of the at least one first flexible medium or the at least one second flexible medium in consecutive adjoining loops around the core forming an article;

e. guiding the at least one first flexible medium or the at least one second flexible medium with a guide assist device that is attached to the device and travels a length of the work area;

f. holding the at least one first flexible medium or the at least one second flexible medium during use with a flexible medium holding device so that the at least one first flexible medium or the at least one second flexible medium is held out of the work area;

g. repeating steps (c) through (f) until a desired length of the article is created; and h. applying a knot simulator, tying a knot, or both in the article at a point along a length of the article so that the article can be used as a fashion accessory.

16. The method of claim 15, wherein the flexible medium holding device is made of plastic, a polymer, or both.

17. The method of claim 16, wherein the flexible medium holding device includes a housing that wraps up the at least one first flexible medium or the at least one second flexible medium and rotates as the at least one first flexible medium or the at least one second flexible medium is looped around the core.

18. The method of claim 15, further including the step of placing the at least one first flexible medium or the at least one second flexible medium in the flexible medium holding device so that the at least one first flexible medium or the at least one second flexible medium is held out of the work area during use until needed.

19. The method of claim 1, wherein the rotation device is in communication with the first holder via one or more gears.

20. The method of claim 1, wherein the first support and the second support are comprised of two structures that substantially encapsulate one or more gears so that the gears are maintained in alignment.

* * * * *